US009856720B2

(12) United States Patent
Grubert

(10) Patent No.: US 9,856,720 B2
(45) Date of Patent: Jan. 2, 2018

(54) BIDIRECTIONAL FLOW CONTROL DEVICE FOR FACILITATING STIMULATION TREATMENTS IN A SUBTERRANEAN FORMATION

(71) Applicant: Marcel A. Grubert, Montgomery, TX (US)

(72) Inventor: Marcel A. Grubert, Montgomery, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 372 days.

(21) Appl. No.: 14/799,134

(22) Filed: Jul. 14, 2015

(65) Prior Publication Data

US 2016/0053575 A1 Feb. 25, 2016

Related U.S. Application Data

(60) Provisional application No. 62/040,279, filed on Aug. 21, 2014.

(51) Int. Cl.
*E21B 34/08* (2006.01)
*E21B 43/12* (2006.01)

(52) U.S. Cl.
CPC ..... *E21B 43/12* (2013.01); *E21B 34/08* (2013.01)

(58) Field of Classification Search
CPC ..... E21B 34/10; E21B 43/12; E21B 43/25; E21B 34/08
See application file for complete search history.

(56) References Cited

U.S. PATENT DOCUMENTS

| | | | |
|---|---|---|---|
| 5,234,055 | A | 8/1993 | Cornette |
| 5,396,954 | A | 3/1995 | Brooks |
| 5,579,844 | A | 12/1996 | Rebardi et al. |
| 5,704,426 | A | 1/1998 | Rytlewski et al. |
| 5,829,520 | A | 11/1998 | Johnson |
| 5,909,774 | A | 6/1999 | Griffith et al. |
| 6,095,247 | A | 8/2000 | Streich et al. |
| 6,397,950 | B1 | 6/2002 | Streich et al. |
| 6,513,599 | B1 | 2/2003 | Bixenman et al. |

(Continued)

FOREIGN PATENT DOCUMENTS

| | | |
|---|---|---|
| RU | 2 160 360 C2 | 12/2000 |
| WO | WO 2007/094897 A2 | 8/2007 |
| WO | WO 2013/037055 A1 | 3/2013 |

*Primary Examiner* — Michael R Wills, III
(74) *Attorney, Agent, or Firm* — ExxonMobil Upstream Research Company—Law Department

(57) ABSTRACT

Bidirectional flow control device for attachment to a tubular member including a nozzle insert comprising a first sealable surface, the nozzle insert comprising a nozzle passage, and a second sealable surface for mating with the first sealable surface, and a first biasing member seat; a cover plate positioned adjacent the first end of the nozzle insert, the cover plate comprising a production orifice and a plurality of stimulation orifices in fluid communication with a plurality of stimulation passages, the cover plate further comprising a second biasing member seat and a biasing member positioned between the first biasing member seat and the second biasing member seat, the biasing member to exert a biasing force to place first sealable surface and second sealable surface in sealing engagement when internal tubular pressure is below a set-point value.

32 Claims, 9 Drawing Sheets

(56) References Cited

U.S. PATENT DOCUMENTS 6,543,538 B2 4/2003 Tolman et al.
6,575,251 B2 6/2003 Watson et al.
6,581,689 B2 6/2003 Hailey, Jr.
6,601,646 B2 8/2003 Streich et al.
6,644,404 B2 11/2003 Schultz et al.
6,666,274 B2 12/2003 Hughes
6,695,067 B2 2/2004 Johnson et al.
6,749,023 B2 6/2004 Nguyen et al.
6,752,206 B2 6/2004 Watson et al.
6,789,623 B2 9/2004 Hill, Jr. et al.
6,817,410 B2 11/2004 Wetzel et al.
6,830,104 B2 12/2004 Nguyen et al.
6,883,608 B2 4/2005 Parlar et al.
6,907,936 B2 6/2005 Fehr et al.
6,935,432 B2 8/2005 Nguyen
6,957,701 B2 10/2005 Tolman et al.
6,983,796 B2 1/2006 Bayne et al.
6,986,390 B2 1/2006 Doane et al.
6,997,263 B2 2/2006 Campbell et al.
7,044,231 B2 5/2006 Doane et al.
7,051,805 B2 5/2006 Doane et al.
7,055,598 B2 6/2006 Ross et al.
7,059,407 B2 6/2006 Tolman et al.
7,096,945 B2 8/2006 Richards et al.
7,100,691 B2 9/2006 Nguyen et al.
7,104,324 B2 9/2006 Wetzel et al.
7,168,494 B2 1/2007 Starr et al.
7,240,739 B2 * 7/2007 Schoonderbeek ..... E21B 34/08 166/227
7,243,732 B2 7/2007 Richard
7,252,142 B2 8/2007 Brezinski et al.
7,264,061 B2 9/2007 Dybevik et al.
7,343,983 B2 3/2008 Livingstone
7,353,879 B2 4/2008 Todd et al.
7,367,395 B2 5/2008 Vidrine et al.
7,392,852 B2 7/2008 Richard
7,407,007 B2 8/2008 Tibbles
7,431,085 B2 10/2008 Coronado et al.
7,431,098 B2 10/2008 Ohmer et al.
7,441,605 B2 10/2008 Coronado et al.
7,477,160 B2 1/2009 Lemenager et al.
7,516,792 B2 4/2009 Lonnes et al.
7,562,709 B2 7/2009 Saebi et al.
7,575,062 B2 8/2009 East, Jr.
7,584,799 B2 9/2009 Coronado et al.
7,591,321 B2 9/2009 Whitsitt et al.
7,735,559 B2 6/2010 Malone
7,798,236 B2 9/2010 McKeachnie et al.
7,891,432 B2 * 2/2011 Assal ..... E21B 23/06 166/148
8,167,047 B2 5/2012 Themig et al.
8,215,411 B2 7/2012 Flores et al.
8,220,542 B2 7/2012 Whitsitt et al.
8,237,585 B2 8/2012 Zimmerman
8,267,177 B1 9/2012 Vogel et al.
8,276,670 B2 10/2012 Patel
8,330,617 B2 12/2012 Chen et al.
8,347,982 B2 1/2013 Hannegan et al.
8,496,055 B2 7/2013 Mootoo et al.
8,985,207 B2 * 3/2015 Thorkildsen ..... E21B 34/063 137/67
9,074,466 B2 * 7/2015 Hailey, Jr. ..... E21B 43/12
2002/0007949 A1 1/2002 Tolman et al.
2004/0007829 A1 1/2004 Ross
2004/0084190 A1 5/2004 Hill et al.
2005/0039917 A1 2/2005 Hailey, Jr.
2005/0263287 A1 12/2005 Achee, Jr. et al.
2006/0118301 A1 6/2006 East, Jr. et al.
2007/0056750 A1 3/2007 John et al.
2008/0093073 A1 4/2008 Bustos et al.
2008/0125335 A1 5/2008 Bhavsar
2008/0142222 A1 6/2008 Howard et al.
2008/0314589 A1 12/2008 Guignard et al.
2009/0032255 A1 2/2009 Surjaatmadja et al.
2009/0084556 A1 4/2009 Richards et al.
2009/0101334 A1 4/2009 Baser et al.
2009/0159279 A1 6/2009 Assal
2009/0159298 A1 6/2009 Assal
2009/0283279 A1 11/2009 Patel et al.
2010/0084134 A1 4/2010 Tulissi et al.
2010/0155064 A1 6/2010 Nutley et al.
2011/0048743 A1 3/2011 Stafford et al.
2011/0168403 A1 7/2011 Patel
2012/0043079 A1 2/2012 Wassouf et al.
2012/0085548 A1 4/2012 Fleckenstein et al.
2012/0090687 A1 4/2012 Grigsby et al.
2012/0111566 A1 * 5/2012 Sherman ..... E21B 34/063 166/297
2012/0145385 A1 6/2012 Lopez
2012/0199349 A1 8/2012 Themig et al.
2012/0292053 A1 11/2012 Xu et al.
2013/0008648 A1 1/2013 Lovorn et al.
2013/0105159 A1 5/2013 Alvarez et al.
2013/0199790 A1 8/2013 Themig et al.
2013/0206425 A1 8/2013 Mazyar et al.
2013/0248174 A1 9/2013 Dale et al.

* cited by examiner

BIDIRECTIONAL FLOW CONTROL DEVICE FOR FACILITATING STIMULATION TREATMENTS IN A SUBTERRANEAN FORMATION

CROSS-REFERENCE TO RELATED APPLICATION

This application claims the benefit of U.S. Provisional Patent Application 62/040,279, filed Aug. 21, 2014, entitled "Bidirectional Flow Control Device for Facilitating Stimulation Treatments in a Subterranean Formation," the entirety of which is incorporated by reference herein.

FIELD

The present disclosure is directed generally to wellbore flow-control devices for hydrocarbon wells, and more particularly to hydrocarbon wells and components and/or methods thereof that include the wellbore flow-control devices.

BACKGROUND

In oil and gas wells, fluids and gases are entering the well along the completion interval based on reservoir pressure and permeability distribution, which often is quite non-uniform. Hence the inflow rate at certain sections of the completion can vary greatly, spatially. For reservoir depletion purposes and well integrity issues, it is desirable to create uniform inflow profiles along the well to provide a more even depletion of the reservoir, or to choke back certain high permeability streaks, which otherwise could draw in early water or gas.

To achieve this, the well completion can be divided into compartments, which may be annularly isolated with packers (e.g. swell packers, etc.). The compartment locations and sizes may be chosen based on reservoir pressure and permeability non-uniformities. Inflow Control Devices (ICD) may be employed in those compartments, forcing the incoming flow through a restriction (e.g. nozzle, tubing or tortuous flow path), thereby creating an additional velocity and fluid density dependent pressure drop that will slow down the flow to create the inflow profile desired.

In certain completions, it also may be desirable to perform one or more stimulation operations to stimulate the subterranean formation and increase a potential for production of the reservoir fluid therefrom. These stimulation operations may include providing a stimulant fluid to specific, or target, regions of the subterranean formation and often utilize stimulation ports within the casing string to provide the stimulant fluid from the casing conduit to the target region of the subterranean formation.

Following stimulation operations, it also may be desirable to control a flow rate of the reservoir fluid into the casing conduit during production of the reservoir fluid from the casing conduit. Typically, a desired flow rate of the reservoir fluid into the casing conduit during production from the subterranean formation is significantly lower than a desired flow rate of the stimulant fluid during stimulation of the subterranean formation. Thus, it may be desirable to decrease and/or restrict a flow rate of the reservoir fluid from the subterranean formation into the casing conduit through the stimulation ports.

As such, a challenge with ICDs is that the size of the flow restriction is fixed during the installation process; hence the ICD is optimized for a certain fluid type and narrow production rate range. This can result in issues should the well require stimulation or be treated for scale (e.g. temporary injection of stimulation/scale prevention fluids), or when a production well is converted into an injection well later in its life. The stimulation rates, can be several times higher than the initial production rates, which a) can cause structural failure of the ICDs and b) change the injection profile to a non-uniform or an undesired profile. A possible solution to this problem is to have the ability to provide a certain flow capability during production flow, and a larger flow capability during stimulation/injection.

Currently there are several possibilities in the industry to achieve this. One is the use of controllable inflow devices (ICV) that can be triggered to change their flow area based on operator input from the surface via hydraulic lines, electric lines or even radio-frequency control tags pumped into the well. Another option is to equip the completion with ICDs, but also have sliding sleeves joints which can be opened (in general, mechanically through a downhole setting tool) for stimulation or injection. Both options require the operator to have well intervention accessibility through a coiled tubing tool, electric or hydraulic lines or radio-frequency controlled tags that require the downhole equipment to have batteries.

Another option is to equip the well completion with ICDs for production, but also have additional check valve style devices that allow flow from one direction (e.g. injection), and close them when the well is being put on production. The downside of this approach is the increased risk of mechanical failure due to having a large number of individual components (e.g. ICDs and valves) in the well. As may be appreciated, if some of those check valves do not close after the stimulation/injection process, then the production inflow profile can be greatly compromised.

As such, there exists a need to address the aforementioned problems and issues. Therefore, what is needed is a simple, cost-effective apparatus that provides one integrated device having a certain flow restriction during production, and another flow restriction when the flow direction is reversed.

SUMMARY

In one aspect, disclosed herein is a bidirectional flow control device for attachment to a tubular member, the tubular member defining an internal flow passage. The flow control device includes a nozzle insert comprising a first end and a second end, the nozzle insert axially positionable within a bore, the bore in fluid communication with the internal flow passage of the tubular member and comprising a first sealable surface, the nozzle insert comprising a nozzle passage in fluid communication with the bore, and a second sealable surface for mating with the first sealable surface, and a first biasing member seat; a cover plate positioned adjacent the first end of the nozzle insert, the cover plate comprising a production orifice in fluid communication with the nozzle passage of the nozzle insert and a plurality of stimulation orifices, the plurality of stimulation orifices in fluid communication with a plurality of stimulation passages, the stimulation passages in fluid communication with the bore, the cover plate further comprising a second biasing member seat; and a biasing member, the biasing member positioned between the first biasing member seat and the second biasing member seat, the biasing member structured and arranged to exert a biasing force sufficient to place first sealable surface and the second sealable surface in sealing engagement when the internal tubular pressure is below a set-point value.

In some embodiments, increasing the internal tubular pressure of the internal flow passage of the tubular member above the set-point value unseats the second sealable surface of the nozzle insert from the first sealable surface of the bore, placing the plurality of stimulation orifices in fluid communication with the internal flow passage of the tubular member.

In some embodiments, the bore is defined by three concentric cylinders, the first concentric cylinder comprising a diameter $d_1$, the second concentric circle comprising a diameter $d_2$ and the third concentric circle comprising a diameter $d_3$.

In some embodiments, the first concentric cylinder is adjacent the internal flow passage of the tubular member, and the third concentric cylinder is adjacent the external surface of the tubular member.

In some embodiments, $d_1<d_2<d_3$.

In some embodiments, the first sealable surface provides an angular transition between $d_1$ and $d_2$ of the first concentric cylinder and the second concentric cylinder of the bore.

In some embodiments, the second sealable surface of the nozzle insert is angularly disposed to mate with the angular transition of the first sealable surface.

In some embodiments, the third concentric cylinder is structured and arranged to receive the cover plate.

In some embodiments, the cover plate threadably engages the third concentric cylinder of the bore.

In some embodiments, the bidirectional flow control device includes a housing, the housing including the bore in fluid communication with the internal flow passage of the tubular member and comprising a first sealable surface.

In some embodiments, the housing is substantially cylindrical and includes an outer surface, at least a portion of the outer surface being threaded for installation into a corresponding threaded bore of the tubular member.

In another aspect, disclosed herein is a method for facilitating stimulation treatments in completions. The method includes the steps of: (a) forming a bore at a first distance along a tubular member, the bore in fluid communication with an internal flow passage of the tubular member and comprising a first sealable surface; (b) installing a nozzle insert within the bore, the nozzle insert comprising a first end, a second end and a nozzle passage in fluid communication with the bore, the nozzle insert comprising a first biasing member seat and a second sealable surface for mating with the first sealable surface; and (c) installing a biasing member adjacent the first biasing member seat; (d) installing a cover plate adjacent the first end of the nozzle insert, the cover plate comprising a production orifice in fluid communication with the nozzle passage of the nozzle insert and a plurality of stimulation orifices, the plurality of stimulation orifices in fluid communication with a plurality of stimulation passages, the stimulation passages in fluid communication with the bore, the cover plate further comprising a second biasing member seat; wherein the biasing member is structured and arranged to exert a biasing force sufficient to place first sealable surface and the second sealable surface in sealing engagement when the internal tubular pressure is below a set-point value.

In some embodiments, the method includes the steps of: (e) flowing a stimulation fluid within the tubular member and increasing the internal tubular pressure of the internal flow passage of the tubular member above the set-point value to unseat the second sealable surface of the nozzle insert from the first sealable surface of the bore; (f) placing the plurality of stimulation orifices in fluid communication with the internal flow passage of the tubular member; and (g) flowing the stimulation fluid into a subterranean reservoir.

In some embodiments, the bore is defined by three concentric cylinders, the first concentric cylinder comprising a diameter $d_1$, the second concentric circle comprising a diameter $d_2$ and the third concentric circle comprising a diameter $d_3$.

In some embodiments, the first concentric cylinder is adjacent the internal flow passage of the tubular member, and the third concentric cylinder is adjacent the external surface of the tubular member.

In some embodiments, $d_1<d_2<d_3$.

In some embodiments, the first sealable surface provides an angular transition between $d_1$ and $d_2$ of the first concentric cylinder and the second concentric cylinder of the bore.

In some embodiments, the second sealable surface of the nozzle insert is angularly disposed to mate with the angular transition of the first sealable surface.

In some embodiments, the third concentric cylinder is structured and arranged to receive the cover plate.

In some embodiments, the step of installing a cover plate includes threadably engaging the third concentric cylinder of the bore.

In some embodiments, the method includes the step of repeating steps (a)-(d) a plurality of times.

In yet another aspect, disclosed herein is a kit of parts for use in facilitating stimulation treatments in completions, comprising: a nozzle insert comprising a first end and a second end, the nozzle insert axially positionable within a bore, the bore in fluid communication with the internal flow passage of a tubular member and comprising a first sealable surface, the nozzle insert comprising a nozzle passage in fluid communication with the bore, and a second sealable surface for mating with the first sealable surface, and a first biasing member seat; a cover plate positioned adjacent the first end of the nozzle insert, the cover plate comprising a production orifice in fluid communication with the nozzle passage of the nozzle insert and a plurality of stimulation orifices, the plurality of stimulation orifices in fluid communication with a plurality of stimulation passages, the stimulation passages in fluid communication with the bore, the cover plate comprising a second biasing member seat; and a biasing member, the biasing member positioned between the first biasing member seat and the second biasing member seat, the biasing member structured and arranged to exert a biasing force sufficient to place first sealable surface and the second sealable surface in sealing engagement when the internal tubular pressure is below a set-point value.

In some embodiments, the kit of parts includes a housing, the housing including the bore in fluid communication with the internal flow passage of the tubular member and comprising a first sealable surface.

In some embodiments, the housing is substantially cylindrical and includes an outer surface, at least a portion of the outer surface being threaded for installation into a corresponding threaded bore of the tubular member.

DETAILED DESCRIPTION

FIGS. 1-9 provide illustrative, non-exclusive examples of a method, apparatus and field test kit directed to bidirectional flow control devices for optimizing both production and stimulation or injection operations, according to the present disclosure, together with elements that may include, be associated with, be operatively attached to, and/or utilize such a method, apparatus or field test kit.

In FIGS. 1-9, like numerals denote like, or similar, structures and/or features; and each of the illustrated structures and/or features may not be discussed in detail herein with reference to the figures. Similarly, each structure and/or feature may not be explicitly labeled in the figures; and any structure and/or feature that is discussed herein with reference to the figures may be utilized with any other structure and/or feature without departing from the scope of the present disclosure.

In general, structures and/or features that are, or are likely to be, included in a given embodiment are indicated in solid lines in the figures, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

Although the approach disclosed herein can be applied to a variety of subterranean well designs and operations, the present description will primarily be related to bidirectional flow control devices for optimizing both production and stimulation or injection operations.

Figure 1:
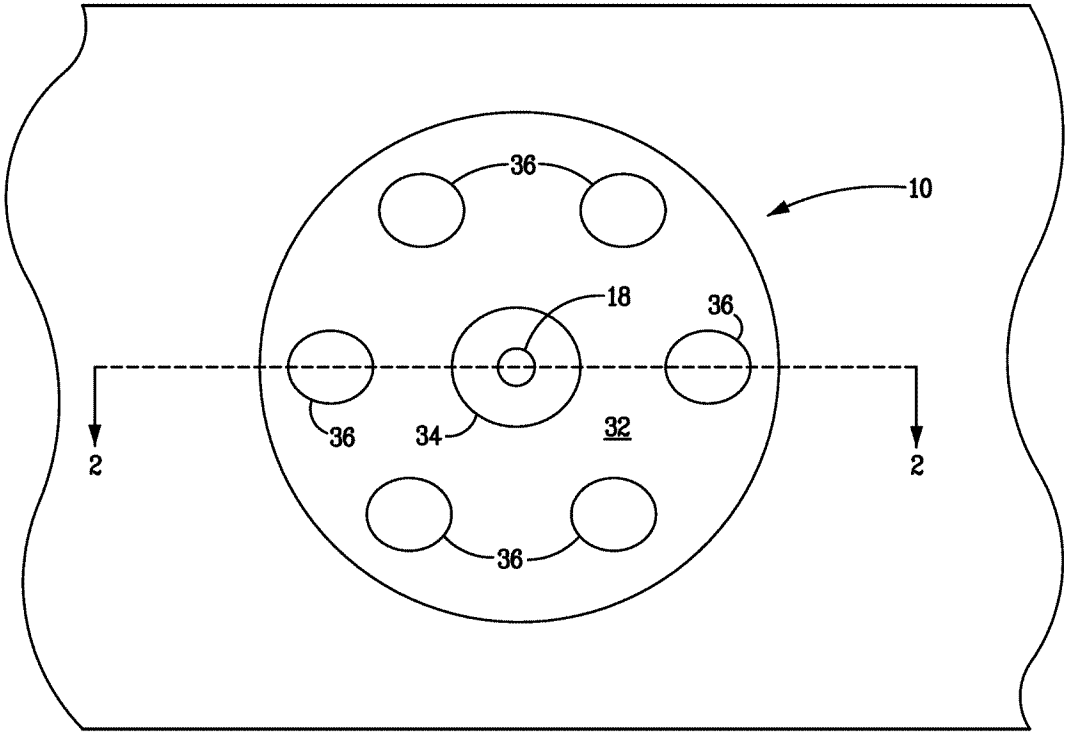
FIG. 1 presents a top plan view of an illustrative, nonexclusive example of a bidirectional flow control device, according to the present disclosure.
Figure 2:
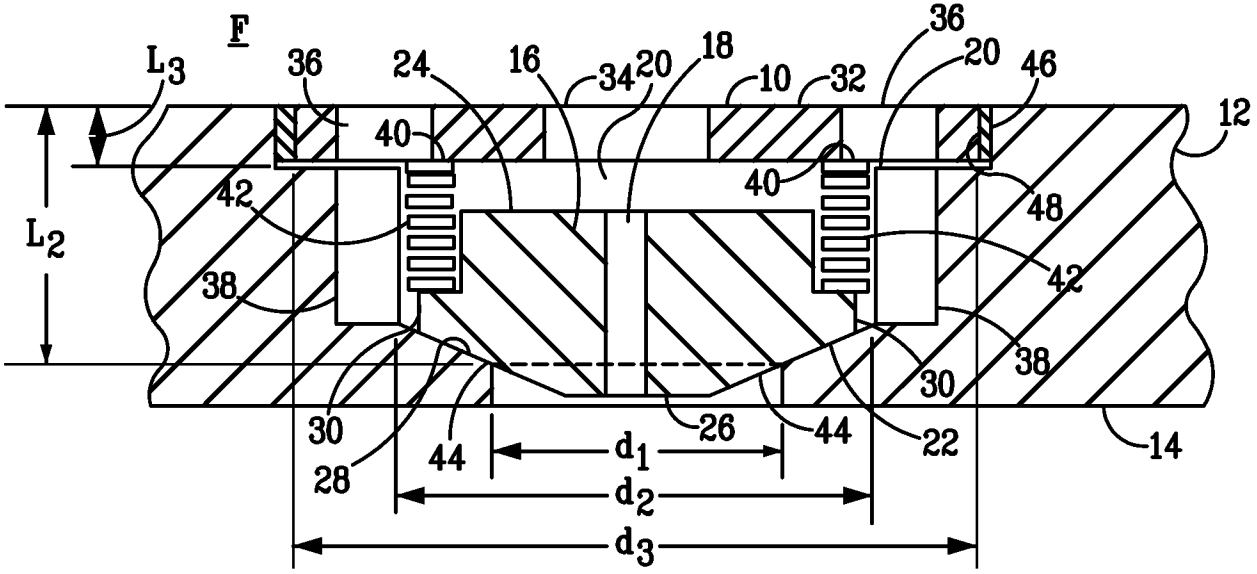
FIG. 2 presents a cross-sectional side view, of an illustrative, nonexclusive example of a bidirectional flow control device, taken along line 2-2 of FIG. 1, according to the present disclosure.

Referring now to FIGS. 1 and 2, illustrated is one embodiment of a bidirectional flow control device 10 for attachment to a tubular member 12, As may be appreciated, the internal surface 14 of tubular member 12 defines an internal flow passage. In this embodiment, the bidirectional flow control device 10 includes a nozzle insert 16 having a nozzle passage 18, nozzle passage 18 in fluid communication with bore 20 of tubular member 12. As will be described in more detail below, nozzle insert 16 is axially positionable within the bore 20, the bore 20 in fluid communication with the internal flow passage of the tubular member 12 and the subterranean formation F.

As shown, tubular member 12 is structured and arranged to provide a first sealable surface 22. The nozzle insert 16 further includes a first end 24 and a second end 26. The nozzle insert 16 also includes a second sealable surface 28 for mating with the first sealable surface 22 of tubular member 12. Nozzle insert 16 also includes at least one first biasing member seat 30, which will be discussed in more detail below.

Still referring to FIGS. 1 and 2, in one embodiment of bidirectional flow control device 10, a cover plate 32 may be positioned adjacent the first end 24 of nozzle insert 16. The cover plate 32 includes a production orifice 34 in fluid communication with the nozzle passage 18 of the nozzle insert 16 and a plurality of stimulation orifices 36. As shown in FIG. 2, the plurality of stimulation orifices 36 align with and are in fluid communication with a plurality of stimulation passages 38, the stimulation passages in fluid communication with the bore 20. In some embodiments, the cover plate 32 may also include at least one second biasing member seat 40.

In some embodiments, bidirectional flow control device 10 further includes at least one biasing member 42, the biasing member 42 positioned between the at least one first biasing member seat 30 and the at least one second biasing member seat 40. To enable bidirectional operation, the biasing member 42 is structured and arranged to exert a biasing force sufficient to place first sealable surface 22 and the second sealable surface 28 in sealing engagement when the internal tubular pressure is below a set-point value. In some embodiments, at least one biasing member 42 comprises one or more coil springs.

Figure 3:
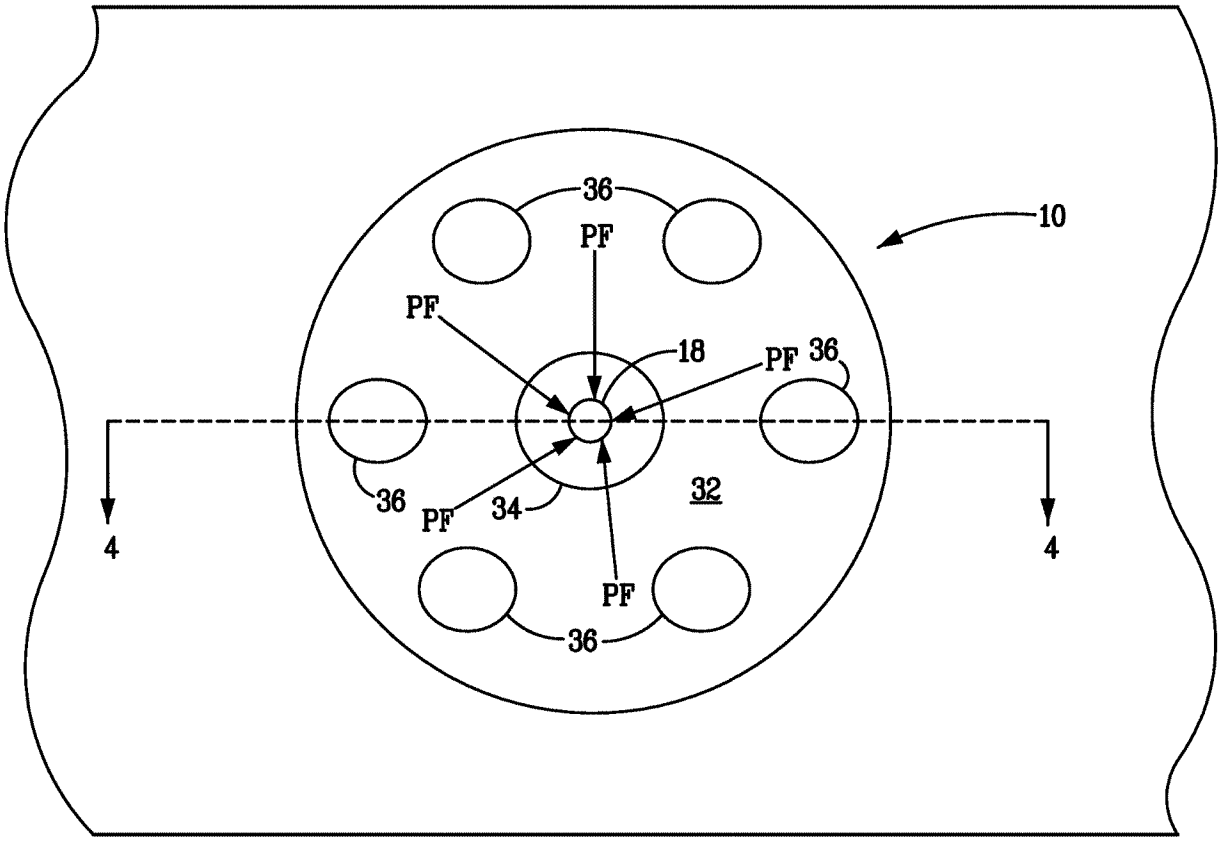
FIG. 3 presents a top plan view of an illustrative, nonexclusive example of a bidirectional flow control device, shown in production mode, according to the present disclosure.
Figure 4:
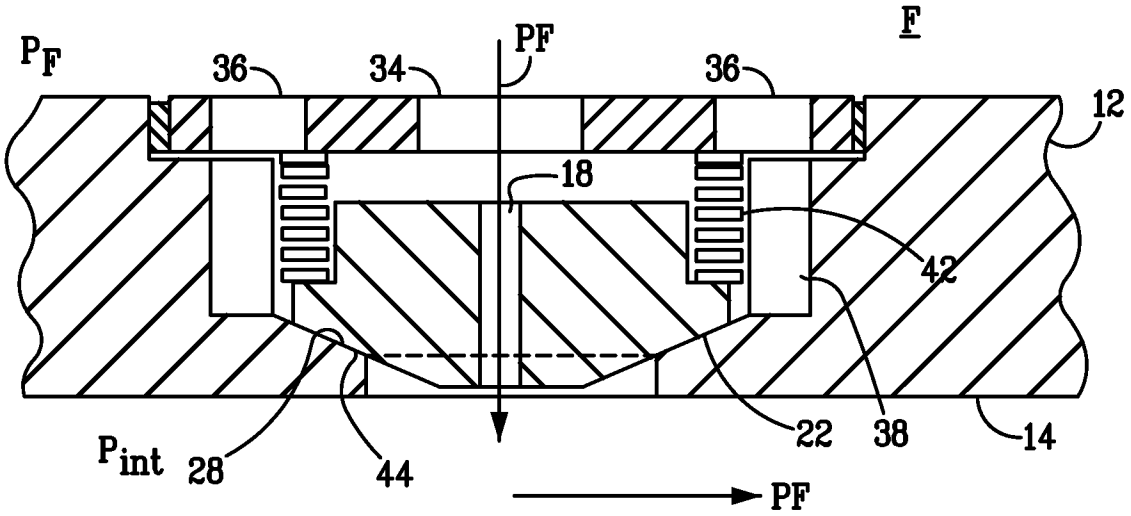
FIG. 4 presents a cross-sectional side view, of an illustrative, nonexclusive example of a bidirectional flow control device, taken along line 4-4 of FIG. 3, shown in production mode, according to the present disclosure.

Referring now to FIGS. 3 and 4, the operation of bidirectional flow control device 10 will now be described with respect to a well in production mode. In production mode, $P_{int}<P_f$ and insufficient to overcome the spring force or set-point value associated with at least one at least one biasing member 42. Thus, under production mode conditions, second sealable surface 28 of nozzle insert 16 is seated, and in sealing engagement with, first sealable surface 22 of tubular member 12. When in this condition, the stimulation orifices 36 are not in fluid communication with the internal flow passage of tubular member 12, there being no flow path to the plurality of stimulation passages 38 from the internal flow passage of tubular member 12. As such, production fluid PF flows from the formation F, through production orifice 34, through nozzle passage 18 of nozzle insert 16 and into the internal flow passage of tubular member 12.

Figure 5:
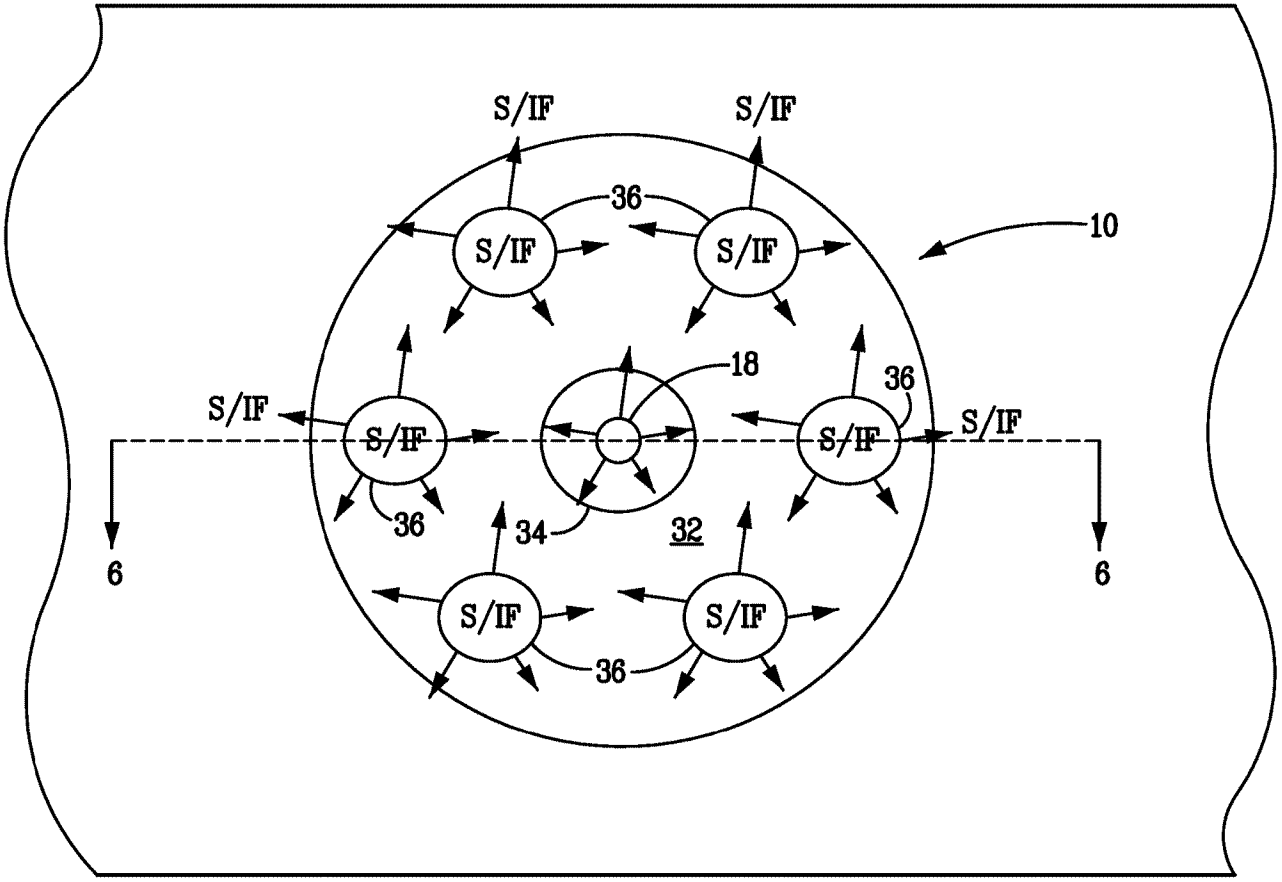
FIG. 5 presents a top plan view of an illustrative, nonexclusive example of a bidirectional flow control device, shown in stimulation/injection mode, according to the present disclosure.
Figure 6:
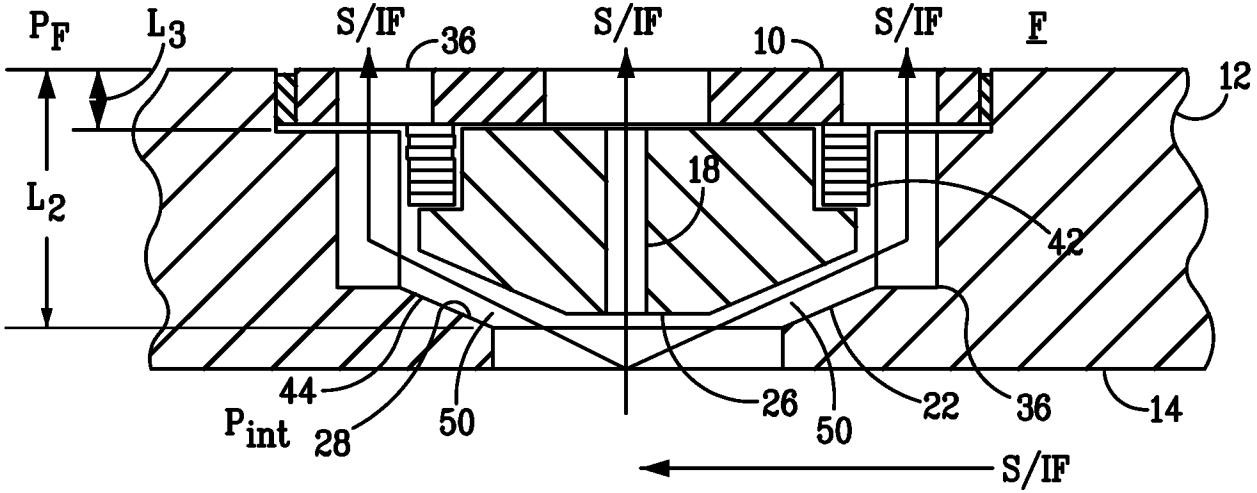
FIG. 6 presents a cross-sectional side view, of an illustrative, nonexclusive example of a bidirectional flow control device, taken along line 6-6 of FIG. 5, shown in stimulation/injection mode, according to the present disclosure.

Referring now to FIGS. 5 and 6, the operation of bidirectional flow control device 10 will now be described with respect to a well in stimulation or injection mode. In stimulation and injection modes, $P_{int}>P_f$ and sufficient to overcome the spring force or set-point value associated with at least one at least one biasing member 42. Thus, under stimulation and injection mode conditions, the pressure exerted on the second end 26 of the nozzle insert 16 compresses the at least one at least one biasing member 42 and second sealable surface 28 of nozzle insert 16 is unseated from the first sealable surface 22 of tubular member 12. In this condition, the stimulation orifices 36 are placed in fluid communication with the internal flow passage 14 of tubular member 12, by the creation of a flow path 50 to the plurality of stimulation passages 38. As such, stimulation or injection fluid S/IF is able to flow from the internal flow passage of tubular member 12, through flow path 50 to the plurality of stimulation passages 38, while simultaneously flowing through nozzle passage 18 of the nozzle insert 16 through production orifice 34, to the formation F. When the flow of stimulation or injection fluid S/IF ceases, $P_{int}$ is reduced to the point where $P_{int}<P_f$ and insufficient to overcome the spring force or set-point value associated with at least one at least one biasing member 42, the second sealable surface 28 of nozzle insert 16 returns to the seated position, in sealing engagement with the first sealable surface 22 of tubular member 12. The well is then returned in production mode.

Referring again to FIG. 2, as shown, in some embodiments, the bore 20 of tubular member 12 may be defined by three concentric cylinders, the first concentric cylinder comprising a diameter $d_1$, the second concentric circle comprising a diameter $d_2$ and the third concentric circle comprising a diameter $d_3$. To form bore 20, a hole of diameter $d_1$ is first drilled through the wall of tubular member 12. Next, a hole of diameter $d_2$ is drilled to a depth of $L_2$ through the wall of tubular member 12. Finally, a hole of diameter $d_3$ is drilled to a depth of $L_3$ through the wall of tubular member 12. When bore 20 is formed in this manner, the first concentric cylinder is adjacent the internal flow passage of the tubular member 12, and the third concentric cylinder is adjacent the external surface of the tubular member 12. In some embodiments, $d_1<d_2<d_3$.

As shown in FIGS. 2, 4 and 6, in some embodiments, the first sealable surface provides 22 an angular transition 44 between $d_1$ and $d_2$ of the first concentric cylinder and the second concentric cylinder of the bore 20 of tubular member 12. In some embodiments, the second sealable surface 28 of the nozzle insert 16 is angularly disposed, in a complementary manner, to mate with the angular transition 44 of the first sealable surface 22.

In some embodiments, the third concentric cylinder is structured and arranged to receive the cover plate 32. In some embodiments, the cover plate 32 threadably engages the third concentric cylinder of the bore 20 through the use of mating threads 46 and 48.

In some embodiments, a method for facilitating stimulation treatments in completions is provided. The method includes the steps of: (a) forming a bore at a first distance along a tubular member, the bore in fluid communication with an internal flow passage of the tubular member and comprising a first sealable surface; (b) installing a nozzle insert within the bore, the nozzle insert comprising a first end, a second end and a nozzle passage in fluid communication with the bore, the nozzle insert comprising a first biasing member seat and a second sealable surface for mating with the first sealable surface; and (c) installing a biasing member adjacent the first biasing member seat; (d) installing a cover plate adjacent the first end of the nozzle insert, the cover plate comprising a production orifice in fluid communication with the nozzle passage of the nozzle insert and a plurality of stimulation orifices, the plurality of stimulation orifices in fluid communication with a plurality of stimulation passages, the stimulation passages in fluid communication with the bore, the cover plate further comprising a second biasing member seat; wherein the biasing member is structured and arranged to exert a biasing force sufficient to place first sealable surface and the second sealable surface in sealing engagement when the internal tubular pressure is below a set-point value.

In some embodiments, the method includes the steps of: (e) flowing a stimulation fluid within the tubular member and increasing the internal tubular pressure of the internal flow passage of the tubular member above the set-point value to unseat the second sealable surface of the nozzle insert from the first sealable surface of the bore; (f) placing the plurality of stimulation orifices in fluid communication with the internal flow passage of the tubular member; and (g) flowing the stimulation fluid into a subterranean reservoir.

Figure 7:
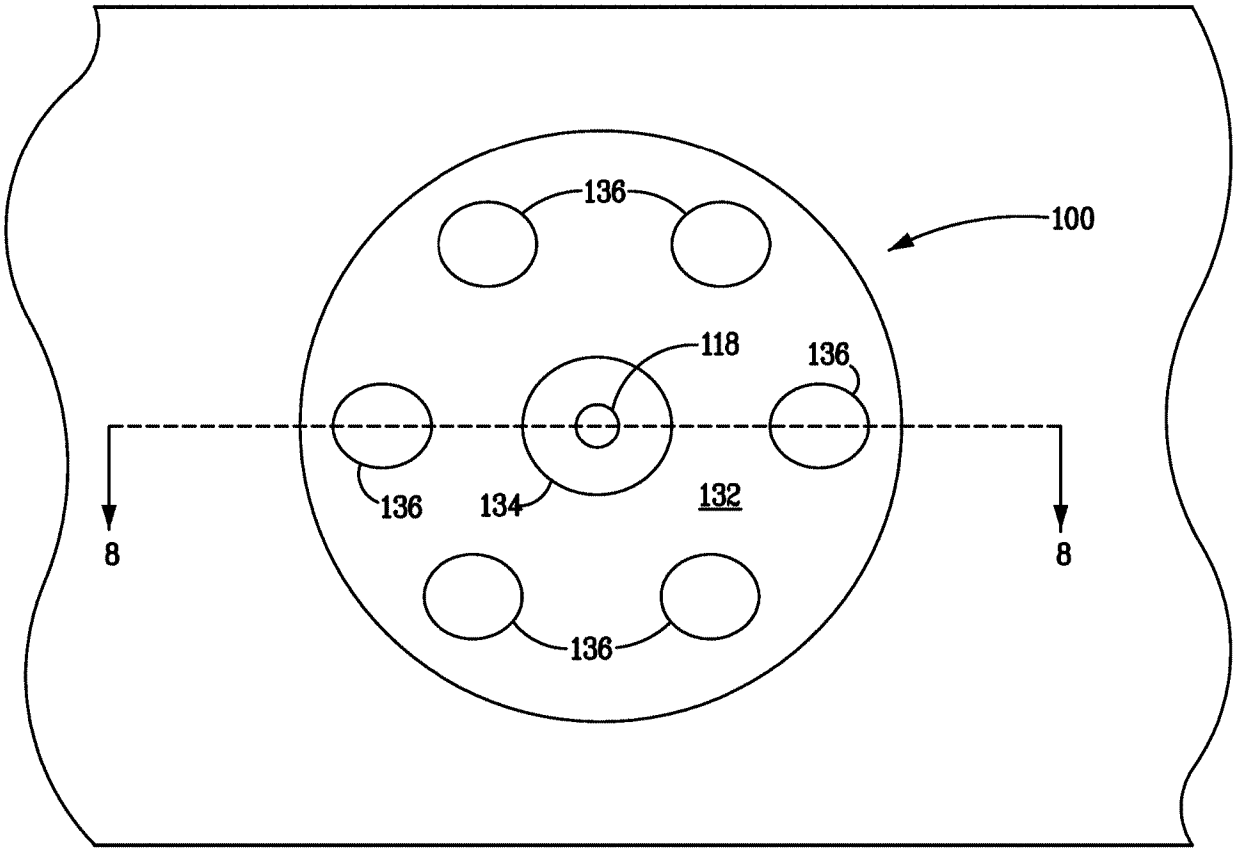
FIG. 7 presents a top plan view of another illustrative, nonexclusive example of a bidirectional flow control device, according to the present disclosure.
Figure 8:
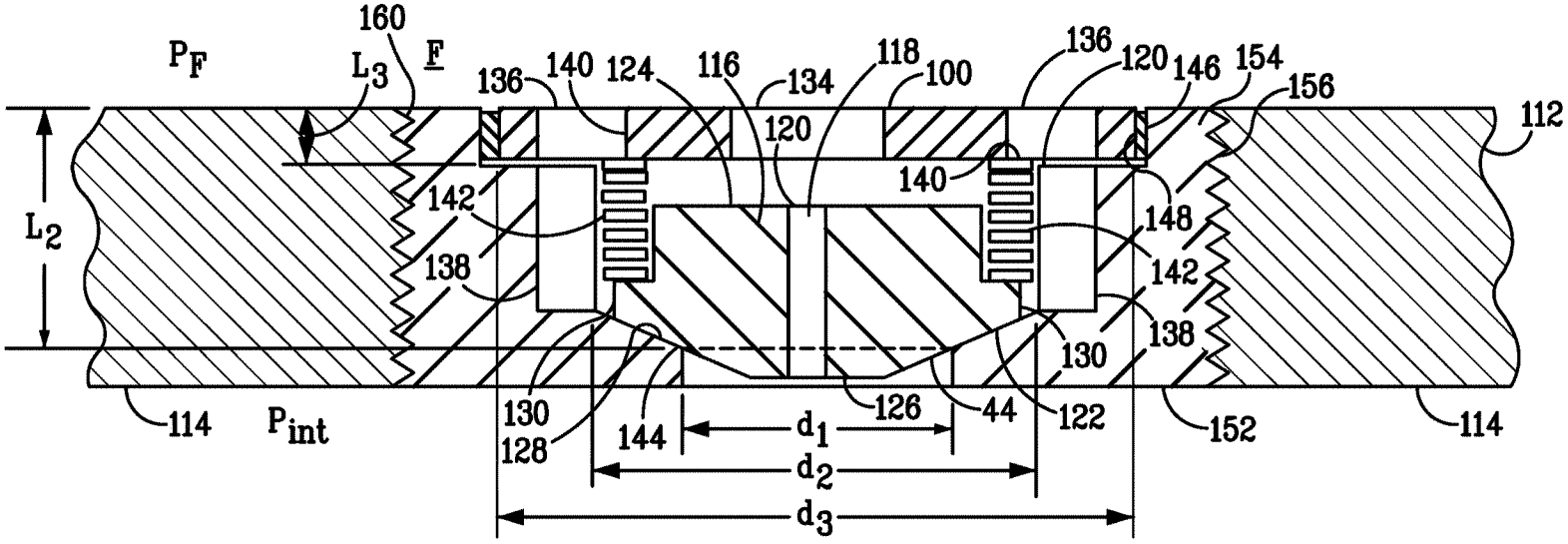
FIG. 8 presents a cross-sectional side view, of another illustrative, nonexclusive example of a bidirectional flow control device, taken along line 8-8 of FIG. 7, according to the present disclosure.

Referring now to FIGS. 7 and 8, another embodiment of a bidirectional flow control device 100 for attachment to a tubular member 112 is illustrated. In this embodiment, the bidirectional flow control device 10 includes a housing 152, the housing 152 including a bore 120. Housing 152 is structured and arranged for inserting into a tubular member (not shown). When inserted into a tubular member, the bore 120 is in fluid communication with the internal flow passage of the tubular member.

Bidirectional flow control device 100 includes a first sealable surface a nozzle insert 116 having a nozzle passage 118, nozzle passage 118 in fluid communication with bore 120 of housing 152. As will be described in more detail below, nozzle insert 116 is axially positionable within the bore 120.

As shown, housing 152 is structured and arranged to provide a first sealable surface 122. The nozzle insert 116 further includes a first end 124 and a second end 126. The nozzle insert 116 also includes a second sealable surface 128 for mating with the first sealable surface 122 of housing 152. Nozzle insert 116 also includes at least one first biasing member seat 130, which will be discussed in more detail below.

In some embodiments of bidirectional flow control device 100, a cover plate 132 may be positioned adjacent the first end 124 of nozzle insert 116. The cover plate 132 includes a production orifice 134 in fluid communication with the nozzle passage 118 of the nozzle insert 116 and a plurality of stimulation orifices 136. As shown in FIG. 8, the plurality of stimulation orifices 136 align with and are in fluid communication with a plurality of stimulation passages 138, the stimulation passages in fluid communication with the bore 120 of housing 152. In some embodiments, the cover plate 132 may also include at least one second biasing member seat 140.

Still referring to FIG. 8, in some embodiments, bidirectional flow control device 100 further includes at least one biasing member 142, the biasing member 142 positioned between the at least one first biasing member seat 130 and the at least one second biasing member seat 140. To enable bidirectional operation, the biasing member 142 is structured and arranged to exert a biasing force sufficient to place first sealable surface 122 and the second sealable surface 128 in sealing engagement when the internal tubular pressure is below a set-point value. In some embodiments, at least one biasing member 142 comprises one or more coil springs.

The operation of bidirectional flow control device 100 will now be described with respect to a well in production mode. In production mode, $P_{int}<P_f$ and insufficient to overcome the spring force or set-point value associated with at least one at least one biasing member 142. Thus, under production mode conditions, second sealable surface 128 of nozzle insert 116 is seated, and in sealing engagement with, first sealable surface 122 of housing 152. When in this condition, the stimulation orifices 136 are not in fluid communication with the internal flow passage of tubular member 112, there being no flow path to the plurality of stimulation passages 138 from the internal flow passage of tubular member 112. As such, production fluid flows from the formation F, through production orifice 134, through nozzle passage 118 of nozzle insert 116 and into the internal flow passage of tubular member 112.

The operation of bidirectional flow control device 100 will now be described with respect to a well in stimulation or injection mode. In stimulation and injection modes, $P_{int}>P_f$ and sufficient to overcome the spring force or set-point value associated with at least one at least one biasing member 142. Thus, under stimulation and injection mode conditions, the pressure exerted on the second end 126 of the nozzle insert 116 compresses the at least one at least one biasing member 142 and second sealable surface 128 of nozzle insert 116 is unseated from the first sealable surface 122 of housing 152. In this condition, the stimulation orifices 136 are placed in fluid communication with the internal flow passage of tubular member 112, by the creation of a flow path (not shown) to the plurality of stimulation passages 138. As such, stimulation or injection fluid is able to flow from the internal flow passage of tubular member 112, through the now exposed flow path to the plurality of stimulation passages 138, while simultaneously flowing through nozzle passage 118 of the nozzle insert 116 through production orifice 134, to the formation F. When the flow of stimulation or injection fluid S/IF ceases, $P_{int}$ is reduced to the point where $P_{int}<P_f$ and insufficient to overcome the spring force or set-point value associated with at least one at least one biasing member 142, the second sealable surface 128 of nozzle insert 116 returns to the seated position, in sealing engagement with the first sealable surface 122 of housing 152. The well is then returned in production mode.

Referring again to FIG. 8, as shown, in some embodiments, the bore 120 of housing 152 may be defined by three concentric cylinders, the first concentric cylinder comprising a diameter $d_1$, the second concentric circle comprising a diameter $d_2$ and the third concentric circle comprising a diameter $d_3$. To form bore 120, a hole of diameter $d_1$ is first drilled through the wall of housing 152. Next, a hole of diameter $d_2$ is drilled to a depth of $L_2$ through the wall of housing 152. Finally, a hole of diameter $d_3$ is drilled to a depth of $L_3$ through the wall of housing 152. When bore 120 is formed in this manner, the first concentric cylinder is adjacent the internal flow passage of the tubular member 112, and the third concentric cylinder is adjacent the external surface of the tubular member 112, when installed in the manner contemplated herein. In some embodiments, $d_1<d_2<d_3$.

In some embodiments, the housing 152 is substantially cylindrical and includes an outer surface 154, at least a portion of the outer surface provided with a thread 156 for installation into a corresponding threaded bore 160 of the tubular member 112.

Also shown in FIG. 8, in some embodiments, the first sealable surface provides 122 an angular transition 144 between $d_1$ and $d_2$ of the first concentric cylinder and the second concentric cylinder of the bore 120 of housing 152. In some embodiments, the second sealable surface 128 of the nozzle insert 116 is angularly disposed, in a complementary manner, to mate with the angular transition 144 of the first sealable surface 122.

In some embodiments, the third concentric cylinder is structured and arranged to receive the cover plate 132. In some embodiments, the cover plate 132 threadably engages the third concentric cylinder of the bore 20 through the use of mating threads 146 and 148.

Figure 9:
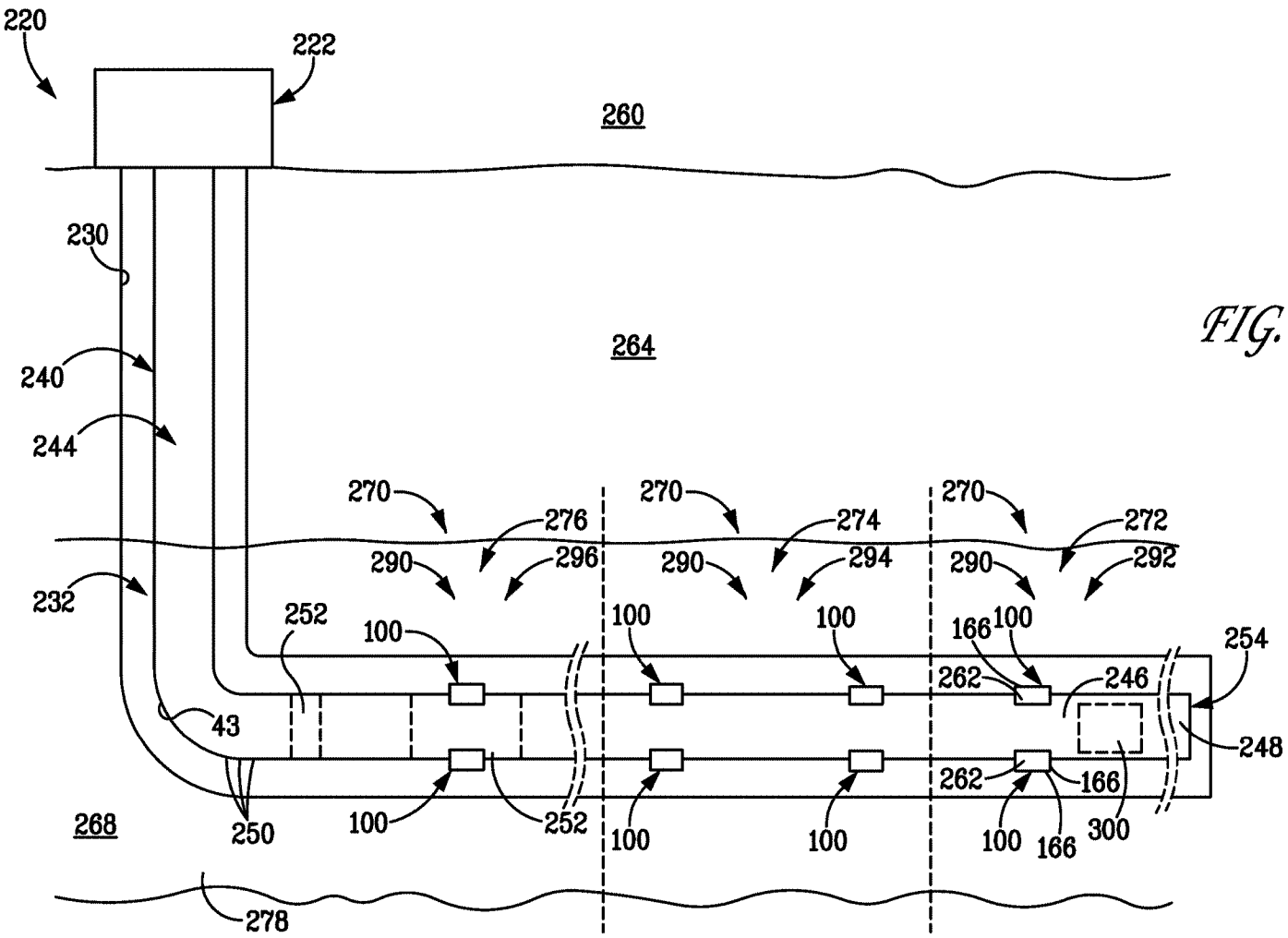
FIG. 9 provides illustrative, non-exclusive examples of a portion of a subterranean well that may include longitudinal positioned bidirectional flow control devices, according to the present disclosure.

Referring now to FIG. 9, a schematic representation of illustrative, non-exclusive examples of a hydrocarbon well 220 that may utilize and/or include the systems and methods according to the present disclosure. Hydrocarbon well 220 includes a wellbore 230 that extends between a surface region 260 and a subterranean formation 268 that is present in a subsurface region 264. Wellbore 230 includes a tubular member (casing) 244 extending between surface region 260 and a terminal end 254 of casing string 240 within the wellbore 230. An annular space 232 is defined by the inner surface of the wellbore 230 and the outer surface 243 of the tubular member 244. Tubular member 244 may be defined by a casing string 240, which also may be referred to herein as a conduit body 240.

As illustrated in dashed lines in FIG. 9, tubular member 244 may include, or may at least temporarily include, one or more fluid isolation devices 290, such as a plug 292, which may be configured to fluidly isolate an uphole portion 246 of tubular member 244 from a downhole portion 248 of the tubular member 244. In addition, at least a portion of hydrocarbon well 220 may include, contain, be operatively attached to, and/or be utilized with one or more bidirectional flow control devices 100 (or bidirectional flow control device 10) according to the present disclosure.

Bidirectional flow control devices 100 selectively provide fluid communication between tubular member 244 and subterranean formation 268 therethrough. Bidirectional flow control devices 100 according to the present disclosure include and/or define a flow passage that is separate, distinct, and/or different from tubular member 244 and selectively conveys a fluid flow between subterranean formation 268 and tubular member 244 or between tubular member 244 and subterranean formation 268. As described hereinabove, depending upon the value of $P_{int}$, $P_f$ and the set-point value, fluid flow may include a fluid outflow for stimulation and injection modes from the tubular member 244 into the subterranean formation 268 and/or a fluid inflow from the subterranean formation 268 into the tubular member 244 for the production mode.

Bidirectional flow control devices 100 may be included in, operatively attached to and/or utilized with any suitable portion of well 220 and/or any suitable component thereof. As an illustrative, non-exclusive example, casing string 240 may include a plurality of casing segments 250, and one or more casing subs 252, which also may be referred to herein as stimulation subs 252 and/or production subs 252, and bidirectional flow control devices 100 may be operatively attached to and/or form a portion of casing segments 250 and/or casing subs 252.

As may be appreciated, bidirectional flow control devices 100, according to the present disclosure, may be utilized during any suitable operation and/or process that may be performed on and/or in well 220 and/or any suitable component thereof. As another illustrative, non-exclusive example, it may be desirable to stimulate subterranean formation 268 by flowing a stimulant fluid through bidirectional flow control devices 100 and into the subterranean formation. Under these conditions, flow control device 100 may define a stimulation flow path 262 that may convey the fluid outflow, in the manner described hereinabove into subterranean formation 268 to stimulate the subterranean formation.

It is within the scope of the present disclosure that all, or substantially all, bidirectional flow control devices 100 present within well 220 may be transitioned from production mode to stimulation mode to stimulate the subterranean formation 268. However, it is also within the scope of the present disclosure that, as indicated in dash-dot lines in FIG. 9, bidirectional flow control devices 100 may be arranged in a plurality of zones 290 of tubular member 244 (with a first zone 292, a second zone 294, and a third zone 296 being illustrated therein). Similarly, subterranean formation 268 may include and/or define a plurality of regions 270 (with a first region 272, a second region 274, and a third region 276 being illustrated therein), which may be stimulated separately and/or independently from one another via bidirectional flow control devices 100 that are associated with first zone 292, second zone 294, and/or third zone 296, respectively. As may be appreciated, a plurality of packers (not shown) may be installed at or near the dash-dot lines of FIG. 9 to facilitate the separate stimulation of regions 272, 274 and 276. The use of packers serves to isolate each region from the other within the annulus 232 of tubular 244.

As an illustrative, non-exclusive example, upon the positioning of one or more fluid isolation devices 300, corresponding bidirectional flow control devices 100 may be provided with stimulant fluid to stimulate the first region 272 of the subterranean formation. After stimulation of first region 272, the fluid isolation devices 290 are repositioned and the second region 274 and/or third region 276 may be stimulated in a similar manner. This process may be repeated any suitable number of times to stimulate any suitable number of regions 270 of the subterranean formation, such as at least 2, at least 4, at least 6, at least 8, at least 10, at least 15, at least 20, at least 25, at least 30, at least 40, or at least 50 regions of the subterranean formation.

As yet another illustrative, non-exclusive example, it also may be desirable to produce a reservoir fluid 278 from subterranean formation 268 by flowing the reservoir fluid from the subterranean formation, through bidirectional flow control devices 100, and into tubular member 244 as the fluid inflow. Under these conditions, $P_{int}<P_f$ and the set-point value, permitting the fluid inflow, as described hereinabove.

In field operations, it may be advantageous to provide the bidirectional flow control device components as a kit of parts. In this regard, disclosed herein is a kit of parts for use in facilitating stimulation treatments in completions, comprising: a nozzle insert comprising a first end and a second end, the nozzle insert axially positionable within a bore, the bore in fluid communication with the internal flow passage of a tubular member and comprising a first sealable surface, the nozzle insert comprising a nozzle passage in fluid communication with the bore, and a second sealable surface for mating with the first sealable surface, and a first biasing member seat; a cover plate positioned adjacent the first end of the nozzle insert, the cover plate comprising a production orifice in fluid communication with the nozzle passage of the nozzle insert and a plurality of stimulation orifices, the plurality of stimulation orifices in fluid communication with a plurality of stimulation passages, the stimulation passages in fluid communication with the bore, the cover plate comprising a second biasing member seat; and a biasing member, the biasing member positioned between the first biasing member seat and the second biasing member seat, the biasing member structured and arranged to exert a biasing force sufficient to place first sealable surface and the second sealable surface in sealing engagement when the internal tubular pressure is below a set-point value.

In some embodiments, the kit of parts includes a housing, the housing including the bore in fluid communication with the internal flow passage of the tubular member and comprising a first sealable surface.

The embodiments disclosed herein, as illustratively described and exemplified hereinabove, have several beneficial and advantageous aspects, characteristics, and features. The embodiments disclosed herein successfully address and overcome shortcomings and limitations, and widen the scope, of currently known teachings with respect to removing liquids from a gas wells.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

It is within the scope of the present disclosure that an individual step of a method recited herein may additionally or alternatively be referred to as a "step for" performing the recited action.

INDUSTRIAL APPLICABILITY

The apparatus and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A bidirectional flow control device for attachment to a tubular member, the tubular member defining an internal flow passage, comprising:

(a) a nozzle insert comprising a first end and a second end, the nozzle insert axially positionable within a bore, the bore in fluid communication with the internal flow passage of the tubular member and comprising a first sealable surface, the nozzle insert comprising a nozzle passage in fluid communication with the bore, and a second sealable surface for mating with the first sealable surface, and a first biasing member seat;

(b) a cover plate positioned adjacent the first end of the nozzle insert, the cover plate comprising a production orifice in fluid communication with the nozzle passage of the nozzle insert and a plurality of stimulation orifices, the plurality of stimulation orifices in fluid communication with a plurality of stimulation passages, the stimulation passages in fluid communication with the bore, the cover plate further comprising a second biasing member seat; and (c) a biasing member, the biasing member positioned between the first biasing member seat and the second biasing member seat, the biasing member structured and arranged to exert a biasing force sufficient to place first sealable surface and the second sealable surface in sealing engagement when the internal tubular pressure is below a set-point value.

2. The bidirectional flow control device of claim 1, wherein increasing the internal tubular pressure of the internal flow passage of the tubular member above the set-point value unseats the second sealable surface of the nozzle insert from the first sealable surface of the bore placing the plurality of stimulation orifices in fluid communication with the internal flow passage of the tubular member.

3. The bidirectional flow control device of claim 2, wherein the bore is defined by three concentric cylinders, the first concentric cylinder comprising a diameter $d_1$, the second concentric circle comprising a diameter $d_2$ and the third concentric circle comprising a diameter $d_3$.

4. The bidirectional flow control device of claim 3, wherein the first concentric cylinder is adjacent the internal flow passage of the tubular member, and the third concentric cylinder is adjacent the external surface of the tubular member.

5. The bidirectional flow control device of claim 4, wherein $d_1<d_2<d_3$.

6. The bidirectional flow control device of claim 5, wherein the first sealable surface provides an angular transition between $d_1$ and $d_2$ of the first concentric cylinder and the second concentric cylinder of the bore.

7. The bidirectional flow control device of claim 6, wherein the second sealable surface of the nozzle insert is angularly disposed to mate with the angular transition of the first sealable surface.

8. The bidirectional flow control device of claim 7, wherein the third concentric cylinder is structured and arranged to receive the cover plate.

9. The bidirectional flow control device of claim 8, wherein the cover plate threadably engages the third concentric cylinder of the bore.

10. The bidirectional flow control device of claim 9, further comprising a housing, the housing including the bore in fluid communication with the internal flow passage of the tubular member and comprising a first sealable surface.

11. The bidirectional flow control device of claim 10, wherein the housing is substantially cylindrical and includes an outer surface, at least a portion of the outer surface being threaded for installation into a corresponding threaded bore of the tubular member.

12. A method for facilitating stimulation treatments in completions, the method comprising the steps of:

(a) forming a bore at a first distance along a tubular member, the bore in fluid communication with an internal flow passage of the tubular member and comprising a first sealable surface;

(b) installing a nozzle insert within the bore, the nozzle insert comprising a first end, a second end and a nozzle passage in fluid communication with the bore, the nozzle insert comprising a first biasing member seat and a second sealable surface for mating with the first sealable surface; and (c) installing a biasing member adjacent the first biasing member seat;

(d) installing a cover plate adjacent the first end of the nozzle insert, the cover plate comprising a production orifice in fluid communication with the nozzle passage of the nozzle insert and a plurality of stimulation orifices, the plurality of stimulation orifices in fluid communication with a plurality of stimulation passages, the stimulation passages in fluid communication with the bore, the cover plate further comprising a second biasing member seat;

wherein the biasing member is structured and arranged to exert a biasing force sufficient to place first sealable surface and the second sealable surface in sealing engagement when the internal tubular pressure is below a set-point value.

13. The method of claim 12, further comprising the steps of:

(e) flowing a stimulation fluid within the tubular member and increasing the internal tubular pressure of the internal flow passage of the tubular member above the set-point value to unseat the second sealable surface of the nozzle insert from the first sealable surface of the bore;

(f) placing the plurality of stimulation orifices in fluid communication with the internal flow passage of the tubular member; and (g) flowing the stimulation fluid into a subterranean reservoir.

14. The method of claim 12, wherein the bore is defined by three concentric cylinders, the first concentric cylinder comprising a diameter d1, the second concentric circle comprising a diameter d2 and the third concentric circle comprising a diameter d3.

15. The method of claim 14, wherein the first concentric cylinder is adjacent the internal flow passage of the tubular member, and the third concentric cylinder is adjacent the external surface of the tubular member.

16. The method of claim 15, wherein $d_1<d_2<d_3$.

17. The method of claim 16, wherein the first sealable surface provides an angular transition between $d_1$ and $d_2$ of the first concentric cylinder and the second concentric cylinder of the bore.

18. The method of claim 17, wherein the second sealable surface of the nozzle insert is angularly disposed to mate with the angular transition of the first sealable surface.

19. The method of claim 18, wherein the third concentric cylinder is structured and arranged to receive the cover plate.

20. The method of claim 19, wherein the step of installing a cover plate includes threadably engaging the third concentric cylinder of the bore.

21. The method of claim 12, further comprising the step of repeating steps (a)-(d) a plurality of times.

22. A kit of parts for use in facilitating stimulation treatments in completions, comprising:

(a) a nozzle insert comprising a first end and a second end, the nozzle insert axially positionable within a bore, the bore in fluid communication with the internal flow passage of a tubular member and comprising a first sealable surface, the nozzle insert comprising a nozzle passage in fluid communication with the bore, and a second sealable surface for mating with the first sealable surface, and a first biasing member seat;

(b) a cover plate positioned adjacent the first end of the nozzle insert, the cover plate comprising a production orifice in fluid communication with the nozzle passage of the nozzle insert and a plurality of stimulation orifices, the plurality of stimulation orifices in fluid communication with a plurality of stimulation passages, the stimulation passages in fluid communication with the bore, the cover plate comprising a second biasing member seat; and (c) a biasing member, the biasing member positioned between the first biasing member seat and the second biasing member seat, the biasing member structured and arranged to exert a biasing force sufficient to place first sealable surface and the second sealable surface in sealing engagement when the internal tubular pressure is below a set-point value.

23. The kit of parts of claim 22, wherein increasing the internal tubular pressure of the internal flow passage of the tubular member above the set-point value unseats the second sealable surface of the nozzle insert from the first sealable surface of the bore placing the plurality of stimulation orifices in fluid communication with the internal flow passage of the tubular member.

24. The kit of parts of claim 23, wherein the bore is defined by three concentric cylinders, the first concentric cylinder comprising a diameter d1, the second concentric circle comprising a diameter d2 and the third concentric circle comprising a diameter d3.

25. The kit of parts of claim 24, wherein the first concentric cylinder is adjacent the internal flow passage of the tubular member, and the third concentric cylinder is adjacent the external surface of the tubular member.

26. The kit of parts of claim 25, wherein $d_1<d_2<d_3$.

27. The kit of parts of claim 26, wherein the first sealable surface provides an angular transition between $d_1$ and $d_2$ of the first concentric cylinder and the second concentric cylinder of the bore.

28. The kit of parts of claim 27, wherein the second sealable surface of the nozzle insert is angularly disposed to mate with the angular transition of the first sealable surface.

29. The kit of parts of claim 28, wherein the third concentric cylinder is structured and arranged to receive the cover plate.

30. The kit of parts of claim 29, wherein the cover plate threadably engages the third concentric cylinder of the bore.

31. The kit of parts of claim 30, further comprising a housing, the housing including the bore in fluid communication with the internal flow passage of the tubular member and comprising a first sealable surface.

32. The kit of parts of claim 31, wherein the housing is substantially cylindrical and includes an outer surface, at least a portion of the outer surface being threaded for installation into a corresponding threaded bore of the tubular member.

* * * * *